US010550646B2

(12) United States Patent
Carlsen et al.

(10) Patent No.: US 10,550,646 B2
(45) Date of Patent: Feb. 4, 2020

(54) STRESS REDUCING SYSTEM AND ASSOCIATED METHOD

(71) Applicant: FMC Kongsberg Subsea AS, Kongsberg (NO)

(72) Inventors: Hans-Paul Carlsen, Notodden (NO); Joao Pedro Castro Gonçalves, Kongsberg (NO); Øystein Ellefsen, Kongsberg (NO); Ronny Orekaasa, Notodden (NO); Graham Alan Ford, Holmestrand (NO); Ove Rørgård, Horten (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 0 days.

(21) Appl. No.: 16/080,004

(22) PCT Filed: Feb. 22, 2017

(86) PCT No.: PCT/EP2017/054010
§ 371 (c)(1),
(2) Date: Aug. 25, 2018

(87) PCT Pub. No.: WO2017/144509
PCT Pub. Date: Aug. 31, 2017

(65) Prior Publication Data

US 2019/0063164 A1 Feb. 28, 2019

(30) Foreign Application Priority Data

Feb. 26, 2016 (NO) ..... 20160327

(51) Int. Cl.
*E21B 17/01* (2006.01)
*E21B 17/08* (2006.01)
*E21B 19/00* (2006.01)

(52) U.S. Cl.
CPC ..... *E21B 17/017* (2013.01); *E21B 17/085* (2013.01); *E21B 19/002* (2013.01)

(58) Field of Classification Search
CPC combination set(s) only.
See application file for complete search history.

(56) References Cited

U.S. PATENT DOCUMENTS 3,523,578 A 8/1970 Nolan, Jr. et al.
3,984,990 A 10/1976 Jones
(Continued)

FOREIGN PATENT DOCUMENTS

GB 2 156 401 A 10/1985
WO WO 2009/102220 A2 8/2009
WO WO 2012/151060 A2 11/2012

*Primary Examiner* — Kyle Armstrong

(57) ABSTRACT

Stress reducing system and associated method for reducing stresses at a desired position in an offshore production or drilling system, the offshore production or drilling system comprising: a seabed structure, a floating structure and a riser (24) extending there between, the riser being tensioned, the riser (24) comprising at least a first part (45) and a second part (46), which second part (46) is connected to the first part (45) via a flexible connection (20) allowing an axial, angular and/or rotational movement between the first and second parts (45, 46), said stress reducing system comprises:—a first sensor (41) for real-time monitoring of stresses at the desired position, positioned at or close to the desired position (20),—an actuating system (42) arranged at the flexible connection (20, the actuating system (42) being connected to said first and second parts (45, 46), and wherein the actuating system (45, 46) is configured to apply a force to the first or second part (45, 46) when the first and second parts (45, 46) are moved out of a neutral position,—a control system (40) adapted to receive monitoring data from the first sensor (41), wherein the control system (40) is connected to the actuating system (42) and is able of providing instruction
(Continued)

signals to the actuating system (42), wherein the control system (40), based on said monitoring data from the first sensor (41), is able to calculate a real-time set of data for control of the applied force of the actuating system (42) and instructing the actuating system (42) to act accordingly, such as to reduce the stress at said desired position.

20 Claims, 10 Drawing Sheets

(56) References Cited

U.S. PATENT DOCUMENTS

| | | | | |
|---|---|---|---|---|
| 4,489,962 | A | 12/1984 | Caumont et al. | |
| 4,516,881 | A | 5/1985 | Beynet et al. | |
| 4,593,941 | A | 6/1986 | Whightsil, Sr. | |
| 4,662,785 | A | 5/1987 | Gibb et al. | |
| 4,854,781 | A | 8/1989 | Sparks et al. | |
| 4,856,827 | A | 8/1989 | Delamare | |
| 4,911,483 | A | 3/1990 | Delamare | |
| 5,951,061 | A | 9/1999 | Arlt, III et al. | |
| 7,559,723 | B2 | 7/2009 | Mohr | |
| 9,650,842 | B2 | 5/2017 | Carlsen et al. | |
| 2004/0031614 | A1 | 2/2004 | Kleinhans | |
| 2006/0065401 | A1* | 3/2006 | Allen | E21B 19/004 166/345 |
| 2008/0031692 | A1 | 2/2008 | Wybro et al. | |
| 2011/0048727 | A1* | 3/2011 | Carlsen | E21B 17/017 166/345 |
| 2016/0084065 | A1* | 3/2016 | DeBerry | E21B 17/085 166/336 |

* cited by examiner

STRESS REDUCING SYSTEM AND ASSOCIATED METHOD

The present invention relates to a system in relation to a riser joint and method for reducing bending moment or other stresses or forces in one or more desired positions along a riser or at equipment whereto the riser is attached. The system may be applied at an upper half of the riser, at a lower half of the riser including: at a wellhead, a connection between a wellhead and a X-mas tree, a lower marine riser package (LMRP), a blow out preventer (BOP), a riser joint, an intervention stack etc. Such forces may result in bending moment, axial stresses such as compression stress, tension stress, and/or torsion stress.

BACKGROUND OF THE INVENTION

Reference is made to document WO 2009102220 A2 which describes the technical field of the present invention, and the challenges with regards to fatigue and tear on subsea components, e.g. at a subsea wellhead. During subsea hydrocarbon extraction, a riser is utilized to establish a conduit between a floating vessel and a subsea wellhead. Due to that the riser in one end is connected to the structure on the seabed and at the other end to a vessel that is under the influence of wind and waves, the riser is experiencing stresses as the vessel moves. The riser is held in tension from the vessel and this will result in bending stresses in the riser as the vessel moves. To minimize these bending stresses, the riser is equipped with a flex joint and or possibly a bend restrictor at the wellhead. A bend restrictor will resist bending and avoid point stresses at the connector, but will not reduce the bending moment, or other forces or stresses resulting in fatigue, as such. An example of a flex joint as used in the industry is shown in U.S. Pat. No. 5,951,061. Such a joint is designed with a certain stiffness to resist bending and, when bending occurs, to force realignment of the riser back to a neutral position.

A constant bending stress in itself will normally not damage the wellhead (or any other weak connection points in the riser) since the connector and the wellhead is designed to withstand these forces. However, the bending may be cyclic, due to vessel movements, and these cycles may result in fatigue problems at the wellhead.

Similarly, a constant tension, compression and/or torsion will normally not damage e.g. the wellhead (or any other desired position) since the connector and the wellhead is designed to withstand these forces. However, the stress, compression and/or torsion may be cyclic, due to vessel movement, and these cyclic movements may result in fatigue problems at the wellhead due to non-constant stresses.

The angular deviation in a flexible joint or connection due to movement of the vessel has a lateral (horizontal) component which gives a bending moment at the wellhead. The movement of the vessel will, in addition to the bending moment created from the lateral part of the angular deviation, also have a component in the length direction (axial) of the riser. There is also possible to have a rotational (torsional) component. All these components will influence the fatigue setting for instance for the wellhead, as these forces will fluctuate leading to variations in the stresses experienced at e.g. the wellhead (if the wellhead is the desired position or one of the desired positions).

Thus, in addition to bending stresses, also compression stress, tension stress and or torsion stress may result in fatigue problems.

The riser has a neutral position, i.e. a position where the stresses and there among the bending moments acting on the riser are low (close to zero). However, due to movements caused by, wind, waves, tension, etc. the riser may move out of its neutral position, wherein some of this movement, at least the movement represented in angular displacement, is allowed by the flexible connection. When this occurs, the riser tends to react by creating a force in the opposite direction compared to the movement out of the neutral position. This opposite direction force is what creates a larger bending moment (and after time: fatigue) on the wellhead (or any other connection/riser part) the most. Thus, to reduce the bending moment, the applicant has solved this issue by, instead of seeking to counteract the movement out of neutral position, rather to apply an additional force which is equal to (or somewhat smaller) than the angular displacement force. The result being that the bending moments experienced at the wellhead is significantly reduced. However, when the forces on the flexible connection acts in another direction, the applied additional force is reduced/shut-off, and the riser is free to move in any direction. Thus, if the riser moves in another direction out of the neutral position than the direction explained above, an additional force may be applied in that direction instead. And, because the riser is moving cyclic, the process is repeated continuously.

Furthermore, the riser is normally connected to heave compensators, which heave compensators (riser tensioning system) make sure that the riser is kept under constant tension, minimizing the loads experience on the subsea wellhead. Under ideal conditions with constant wind, waves and sea currents, it is theoretically possible to keep the riser in constant tension using the heave compensators, and in this way maintaining constant drag forces on the wellhead (or any other desired position along the riser), i.e. to keep the forces from the riser in a neutral position where the sum of forces is at a preferred value. Under such ideal conditions, the wellhead, or any other point along the riser, would experience small, if any, variations in compression/stresses, thereby reducing, or even eliminating, fatigue problems due to compression/tension stresses. However, when used offshore, i.e. when used in real conditions, it has proven that the stress or tension forces experienced in any desired position when using the heave compensators are not always at the preferred value (i.e. referred to as the neutral position), but rather that the forces are higher (downward load) or lower (increased drag) compared to the neutral position/point and fluctuate around the neutral position. In addition, the stresses or forces are not constant due to wind, waves, drift off, etc. Thus, in practice, it has proven that such field conditions result in fatigue problems in said desired position.

An objective of the present invention is to provide a system and method for applying a force on a flexible connection in a riser having even more accurate measurements, i.e. real-time data sets based on real-time measurements.

Furthermore, another objective of the present invention is to provide a solution which compensates for a larger amounts of frictions that may occur in the system.

Another objective of the present invention is to reduce the variations in stresses experienced in a desired position in an offshore production or drilling system.

SUMMARY OF THE INVENTION

The objective is achieved by a system for reducing bending moments at a desired position along a riser, i.e. a riser column, as well as a method of reducing bending moments at a desired position along a riser column in accordance with the independent claims, where the dependent claims describe other characteristics of the invention.

With the terminology column should be understood to be the access column to the well, there among including the riser, riser joints, connection to fixed subsea installations, such as wellheads, X-mas trees etc.

In another embodiment, the objective of reducing axial stresses is achieved by a system allowing and controlling axial movement between a first part and a second part of the riser, or second and third parts of a riser etc.

The invention relates to a stress reducing system for reducing stresses at a desired position in an offshore production or drilling system, the offshore production or drilling system comprising: a seabed structure, a floating structure and a riser extending therebetween, the riser being tensioned, the riser comprising at least a first part and a second part, which second part is connected to the first part via a flexible connection allowing an axial, angular and/or rotational movement between the first and second parts, said stress reducing system comprises:

- a first sensor for real-time monitoring of stresses at the desired position, positioned at or close to the desired position,
- an actuating system arranged at the flexible connection, the actuating system being connected to said first and second parts, and wherein the actuating system is configured to apply a force to the first or second part when the first and second parts are moved out of a neutral position,
- a control system adapted to receive monitoring data from the first sensor, wherein the control system is connected to the actuating system and is able of providing instruction signals to the actuating system, wherein the control system, based on said monitoring data from the first sensor, is able to calculate a real-time set of data for control of the applied force of the actuating system and instructing the actuating system to act accordingly, such as to reduce the stress at said desired position.

Method of reducing stress at a desired position in an offshore production or drilling system, the offshore production or drilling system comprising: a seabed structure, a floating structure, and a riser extending therebetween, the riser being tensioned, the riser comprising at least a first part and a second part, which second part is connected to the first part via a flexible connection allowing an axial, angular and/or rotational movement between the first and second parts and a stress reducing system comprising an actuating system arranged at the flexible connection, the actuating system being arranged to be connected to said first and second parts, and wherein the actuating system is configured to apply a force to the first or second part when the first and second part are moved out of a neutral position, the method comprises the steps of:

- real-time monitoring of stresses at or close to the desired position using a first sensor,
- operating a control system to calculate a real-time set of data based on monitoring data from the first sensor and controlling the actuating system accordingly, and
- regulating the applied force of the actuating system to provide a force which reduces the forces at said desired position.

There may be one or more desired position, i.e. a first, second, third, fourth, fifth, sixth etc. desired position, where the desired positions may be one or more of the following, or combinations thereof:

a) in a lower half of the riser column, such as:
at a wellhead,
in a distance below an upper end of the wellhead,
at a connection between the wellhead and a X-mas tree,
at a lower marine riser package (LMRP),
at a blow out preventer (BOP),
at a riser joint, or
b) in an upper half of a riser column, such as:
at a position in the connection between the riser and the floating vessel,
at the riser slip joint, or
at any other position in the upper half of the riser which may experience challenges related to fatigue or tear.

In order to reduce, minimize variations in stresses experienced at any first, second, third, fourth, fifth, sixth desired position, the system may comprise more than one flexible connections and actuating systems, such that two, three, four, five, six, seven etc. flexible connections with their own actuating systems. Typically, the number of actuating systems correspond to the number of desired positions, however, this may not always be the case as there also may be more or less desired positions compared to the number of actuating systems. The actuating systems may be operated by a common control system or separate control systems. In addition, the flexible connection may be identical connections which allows for relative angular movement between different riser parts, or they may be different flexible connections. Alternatively, one flexible connection may be multi-operational, i.e. one flexible connection can allow more than one type of movement such as combinations of angular and axial movement and/or torsional movement.

In addition to multi-operational flexible connection(s), there may be one or more stress reducing systems where one stress reducing system may have a dedicated function or be multi-functional. If one stress reducing system has one dedicated function, it is typically adapted to handle either bending moments, axial stress (tension/compression) or torsional stress. As such, one or more stress reducing systems may be arranged in one system to handle at least one of the different stresses. Furthermore, if one stress reducing system is multi-functional, it is adapted to handle more than one of said bending moments, axial stress (tension/compression) and torsional stress. Thus, one stress reducing system may be adapted to handle all stresses that may occur or, alternatively, in combination with one or more stress reducing system with dedicated functions or other multi-functional stress reducing systems.

First embodiment:

In a first embodiment, it is provided a system for reducing bending moments at a desired position along a riser, the riser being tensioned and connected to a floating structure and a seabed structure and comprises a first part and a second part, which first and second parts are connected by a flexible joint allowing the first part and the second part to be angular displaced relative each other, the system comprises:

- a first sensor for real-time monitoring of bending moments at the desired position, positioned at or close to the desired position,
- an actuating system arranged at the flexible connection, the actuating system being connected to said first and second parts, and wherein the actuating system is configured to apply a force to the first or second part when the first and second part are moved out of a neutral position, which force is applied in the same direction as the movement out of neutral position,
- a control system adapted to receive monitoring data from the first sensor, wherein the control system is connected to the actuating system and is able of providing instruction signals to the actuating system, wherein the control system, based on said monitoring data from the first sensor, calculates a real-time set of data for control of the applied force of the actuating system to provide a reduced bending moment at said desired position along the riser and instructing the actuating system to act accordingly.

The riser can be any riser used offshore, including;

marine riser, production riser, drilling riser, open sea workover riser, riser-in-riser, which is solutions where one riser is arranged on the radial outside of another riser, etc.

The system provides force and position control based on real-time measurements of forces and position/orientation in any desired position in the riser. The system may comprise a controller translating the sensor signals to the actuating system by use of one of the following controllers; PID (Proportional-Integral-Derivate) controller, MPC (Model Predictive Controller), LQC (Linear Quadratic Controller), Adaptive Controller. The input to the control system may be: forces on different riser system components, angles on different riser system components, bending moments on different riser system components etc. Forces or moments that may be compensated for at the desired position may include both internal and external forces, including: moments caused by sea state and rig movement, moments caused by drag in the Riser, vortex induced moments affecting the riser system, alternating moments caused by change in the riser tension, pipe-in-pipe effects and out of phase moments, friction effects from e.g. bearings or rubber elements.

The power source for the system may be a local hydraulic power unit HPU supplying the hydraulic cylinders based on the control system input to compensate, or a local battery unit supplying electrical power to actuators and control system, or electric power from the rig or any other subsea source generating electricity.

The connection or joint between the two riser parts may be any connection allowing angular displacement but which transfers tension between the riser parts. Such a joint may be a ball joint, a bellow joint or any other suitable joint etc.

The floating structure may be any structure able to provide a tension force in the riser, such as a floating vessel or platform, a floating buoy etc. The connection to the floating structure may be a direct connection to the floating structure, or alternatively via tension means such as tension wire or other suitable means. Tension is applied in the riser to minimize the weight on the wellhead.

The control system may, in addition to be connected to the actuating system, be adapted to direct high pressure from a pressure bank and or a pump system to dedicated first or second chambers of the different hydraulic cylinder dependent on the calculated real-time set of data.

The system may further comprise:

a second sensor for real-time monitoring of a bending angle θ at the flexible connection, and a third sensor for real-time monitoring of tension in the riser, and wherein the control system calculates the real-time set of data for control of the applied force of the actuating system based on monitoring data from the first sensor, the second sensor and the third sensor. However, it shall be noted that there may be provided even more sensors at different locations along the riser. The position of the third sensor may be anywhere along the riser, however it is appropriate to arrange the third sensor in a position along the riser where the expected tension forces are relatively large relative other positions along the riser.

According to an aspect, the first sensor may comprise a sensor system providing input in relation to the magnitude, direction and/or orientation of the bending moment.

According to an aspect, the actuating system is arranged around a circumference of the flexible connection.

According to an aspect, the actuating system comprises a set of hydraulic actuators, wherein each hydraulic actuator comprises a cylinder, and wherein each cylinder comprises a cylinder barrel and a through-going piston rod, the through-going piston rod having a fixed piston separating an inner volume in the cylinder barrel in a first volume and a second volume.

The piston rods of each hydraulic cylinder may extend substantially in the same direction as a longitudinal axis of the riser or the piston rods may alternatively be provided at an angle relative the longitudinal axis of the riser. Such a configuration provides for a reduced footprint, i.e. less radial extension of the system, which makes it easier to guide cables, umbilicals etc. around or on the outside of the system, as well as making the system more compact. The number of hydraulic cylinders may be any number suitable for covering the needs of the specific projects, e.g. ranging from 3 hydraulic cylinders and up, i.e. any number of cylinders up to 100+ cylinders, whatever being appropriate and suitable in the desired project.

In an aspect of the actuating system, a first volume in one cylinder may be connected to a first volume or a second volume in another cylinder, and/or a second volume in one cylinder is connected to a first volume or a second volume in another cylinder. The assembly of the hydraulic cylinders in the actuating system may thus be cross-linked cylinders. The assembly may provide for a balanced push/pull force generated by hydraulic cylinders in optimal positions setting up a moment at a location in the riser system.

The hydraulic cylinders may be double acting, i.e. they may function in both push and pull direction. Double acting cylinders have the same piston area on both sides of the piston. The piston may have at least one through-going hole extending from the first chamber to the second chamber providing fluid communication from the first chamber to the second chamber in the hydraulic cylinder. Alternatively, by adding a valve providing fluid communication between the first and second chamber the system can be neutralized either by having a valve that is: remote operated by electricity or hydraulic pressure fail safe open, locally operated with ROV interface, or automatically operated with pilot signal/pressure.

When using even number of hydraulic actuators, the cylinder pairs can use the same hydraulic pressure by crossing the chambers (one cylinder pushing and one cylinder pulling) in order to minimize introduction of vertical forces and shear forces. Actuators can be placed in vertical position, or at an angle towards the riser to minimize torsion effects and reduce the anisotropic effects.

The hydraulic cylinders in the actuating system can be clamped on or integrated in the riser system as a new component. The hydraulic cylinders can be fixed or connected to different riser system components, including flex joint, flexible connection, riser adapters, lower marine riser package (LMRP) etc. using linkages, bolts, screws, clamps or any other suitable means.

According to an aspect, the desired position may be in a lower half of the riser, such as: at a wellhead, in a distance below an upper end of the wellhead, at a connection between the wellhead and a X-mas tree, at a lower marine riser package (LMRP), at a blow out preventer (BOP) or at a riser joint.

According to an aspect, the first sensor may be positioned at a distance from the desired position, e.g. the desired position is a position in a distance below the upper end of the wellhead and the first sensor is positioned at a connection between the X-mas tree and an intervention stack. More specifically, the desired position may be literally at, in or on the component in the desired position, e.g. in a connection or in the lower marine riser package, but may also be in a position close to the desired position. E.g. if the desired position is a weld in the wellhead, it is better to arrange the first sensor away from the weld such that the strength of the weld is not additionally reduced by arranging a sensor in or on it. Then one may, be monitoring the sensor, calculate the bending moments in the weld using known calculation methods such as extrapolation etc.

In another aspect of the invention, the desired position may be in an upper half of the riser. Such a position may be in the connection between the riser and the floating vessel, at the riser slip joint or any other position in the upper half of the riser which may experience challenges related to fatigue or tear.

According to an aspect of the invention, the system may further comprise means for monitoring readings of, and the control system calculates the real-time data set taking into account the monitoring readings from one or more of the following additional parameters:

- angle of different riser components,
- temperature of different riser components,
- tension of different riser components vs inner pressure of a fluid in the riser,
- torsion of different riser components vs inner pressure of a fluid in the riser,
- pressure experienced at different riser components,
- tension in the riser vs. wave/currents,
- tension in the riser vs. tension applied from a tension system holding the riser.

The means for monitoring readings, e.g. sensors, of these additional parameters can be any of the following:

- strain type sensors for measurement of riser forces in several locations: such as electric or optical fiber sensors,
- position sensors for measurement of riser system components position and orientation of the type: such as accelerometers, gyroscope, magnetometer, inertial, etc.

According to an aspect, the system may comprise a second flexible connection, which second flexible joint allows either

- the first part and the second part to be angular displaced relative each other, or
- the second part and a third part of the riser to be angular displaced relative each other, and wherein the system comprises:
  - a first sensor for real-time monitoring of bending moments at the desired position, positioned at or close to the desired position,
  - a second actuating system arranged at the second flexible connection, the actuating system being connected to said second and third parts, and wherein the second actuating system is configured to apply a force to the second or third part when the second and third part are moved out of a neutral position, which force is applied in the same direction as the movement out of neutral position,
  - a control system adapted to receive monitoring data from the first sensor, wherein the control system is connected to the second actuating system and is able of providing instruction signals to the second actuating system, wherein the control system, based on said monitoring data from the first sensor, calculates a real-time set of data for control of the applied force of the second actuating system to provide a reduced bending moment at said desired position along the riser and instructing the second actuating system to act accordingly.

For example, the first flexible connection may allow an axial and/or rotational movement between the first and second parts, i.e. as part of a system compensating for tension, compression and or torsion at any desired position(s), while the second flexible connection allows for angular movement between the first, second part and or third part, i.e. reducing bending moment in another desired position(s). Thus, one stress reducing system may be provided to handle bending moments, while another second and possibly third stress reducing system may be provided for handle tension or compression and/or torsion.

The second actuating system may comprise all the same elements as the actuating system between the first and second riser parts described above.

According to an aspect, the system is adapted to reduce bending moments at a second desired position along the riser. Said second desired position may be any of the desired positions along the riser, such as in a lower half of the riser, including at the wellhead, in a distance below an upper end of the wellhead, at a connection between the wellhead and a X-mas tree, at a lower marine riser package (LMRP), at a blow out preventer (BOP) or at a riser joint, or alternatively in an upper half of the riser, including: in the connection between the riser and the floating vessel, at the riser slip joint or any other position in the upper half of the riser which may experience challenges related to fatigue or tear. The second actuating system may be connected to the same control system as the actuating system arranged at the flexible connection between the first and second riser parts, or alternatively, to an additional control system.

The invention further relates to a method of reducing bending moments at a desired position along a riser, the riser being tensioned and connected to a floating structure and a seabed structure and comprises a first part and a second part, which first and second parts are connected by a flexible joint allowing the first part and the second part to be angular displaced relative each other, and an actuating system arranged at the flexible connection, the actuating system being arranged to be connected to said first and second parts, and wherein the actuating system is configured to apply a bending moment to the first or second part when the first and second part are moved out of a neutral position in the same direction as the displacement out of the a neutral position, the method comprises the steps of:

- real-time monitoring of bending moments at or close to the desired position along the riser using a first sensor,
- operating a control system to calculate a real-time set of data based on monitoring data from the first sensor and controlling the actuating system accordingly, and
- regulating the applied force of the actuating system to provide a reduced bending moment at said desired position along the riser.

According to an aspect, the method further comprises the step of reducing bending moments at a second desired position in/along a riser by using a second actuating system and the same or an additional control system.

There is provided a system for a riser with a joint connecting two parts of a riser where the two parts of the riser are allowed angular displacement relative each other. This may be achieved with a normal flex joint, possibly a ball joint, a bellow joint, or other joint allowing one part of the riser to move relative the other riser part, but where the tension forces in the riser are transferred through the joint. The system may comprise means for connection to the two parts of the riser at a distance from the flexible joint.

According to an aspect the system may comprise connection means for connection to a part of a riser relatively still and connected to a seabed installation and connection means for connection to a part of a riser allowed to move relative the seabed. By this the system is connectable to the two different riser parts connected by a joint. According to an aspect the actuating system may be such arranged that in a neutral position of the two parts of the riser the actuating system provides mainly equal forces around the circumference of the riser and in a non-neutral position provides a force on the two parts of the riser, which force will act to move the parts of the riser further away from the neutral position.

The actuating system will thereby provide a "negative stiffness" to the joint arrangement of the two parts of the riser with the system. Stiffness should be understood to be the resistance of an elastic arrangement to deflection or deformation by an applied force. An elastic arrangement will deform under stress, but return to original form. The actuating system in the system will add a force between the two parts of the riser, normally connected with a hinged joint, such that to move the two parts back to the neutral position this force must be overcome, i.e. it acts as a negative stiffens for the arrangement, in relation to movements from the neutral position. When one part of the riser moves out of the neutral position, or has an angled position in relation to the neutral position, the actuating system will act on the two parts of the riser and at least initially try to increase the angle the part of the riser has formed with the neutral position.

In a neutral position the longitudinal axes of the two parts of the riser may be parallel. It is also possible to envisage a neutral position where the part of the riser kept still in relation to the seabed, has a longitudinal axis which forms an angle with a vertical axis, and the longitudinal axis of the other riser part in a neutral position is mainly vertical. In such a situation the two different axes of the two parts of the riser, may, in a neutral position with the system connected to the two riser parts, form an angle between them. According to the invention the actuating system will in this neutral position, when this is given, provide a force on the two parts that is mainly equal around the circumference of the riser and thereby keep the two riser parts in this neutral position. It is when the relative position between the two riser parts comes out of this neutral position that the actuating system provides a force trying to further move the two riser parts out from the neutral position, thereby providing a negative stiffness to the connection between the two riser parts with the system.

The additional force provided by the actuating system when the two riser parts are not in the neutral position must be overcome to move the riser parts back to a neutral position. The total riser arrangement will normally comprise the two riser parts, which riser parts are connected to each other with a hinged connection allowing angular deviation between the two riser parts. This hinged connection will transfer tension between the riser parts across the connection. The total riser arrangement will normally also be connected to a tension arrangement on a floating vessel. The vessel may be a floating platform, a ship or similar. The tension arrangement provides tension in the riser and will try to compensate for movements of the vessel due to wind, waves and currents and also the influences of the same on the riser as such.

According to the invention the system in relation to the connection between the two riser parts comprises a system that induces bending forces to the connection between the two riser parts, in such a manner that with an angle from the neutral position in the connection the system will trying to increase this angle. The resulting force applied by a system according to the present invention will give a more precise and accurate calculation of the actual bending moments at the desired location where bending moments are to be reduced. Thus, the present system and method provide a more active and real-time measurement/calculations, and also force applied by the actuating system, in relation to the more passive systems of the prior art.

Second embodiment:

In a second embodiment, where the stress is compression, it is provided a system wherein the flexible connection comprises a dynamic seal allowing the first part and the second part axial movement relative each other, the actuating system being arranged above a BOP in the riser and is configured to apply a force on the first or second part in the axial direction when the first and second parts are moved out of an axially neutral position. There will be compression stress in the system as a result of angular deviation of the flexible riser joint or connection as the other component of the deviation compared to the element creating the bending moment.

Typically, the neutral position in all aspects corresponds to the position where the riser is tensioned, e.g. by tensioning system, and the desired position experiences zero forces or stress or constant forces or constant stress. In theory, this should be enough, and under ideal conditions the desired position would not experience any fluctuation forces or stress resulting in fatigue challenges over time. However, it has proven that the desired position experiences forces or stresses which are not constant, i.e. the forces or stresses will fluctuate or variate around the neutral position and result in fatigue over time. Thus, the invention minimizes and or reduces the forces or stresses experienced at the desired position. This is achieved by for example a short section of flexible connection, i.e. axially flexible connection such as a telescopically controlled pipe, above the BOP in the riser. The telescopically controlled pipe comprising the actuating system. In order to reduce or eliminate the stress forces in the desired position, e.g. wellhead or other part of the riser, a first sensor configured to monitor stresses at the desired position and provide real-time monitoring of stresses at the desired position. The actuating system, is arranged at the flexible connection, and is configured to apply a force to the first or second part when the first and second parts are moved out of a neutral position. The control system is adapted to receive monitoring data from the first sensor, wherein the control system is connected to the actuating system and is able of providing instruction signals to the actuating system, wherein the control system, based on said monitoring data from the first sensor, is able to calculate a real-time set of data for control of the applied force of the actuating system and instructing the actuating system to act accordingly, such as to reduce the stress at said desired position either by compensating for tension or compression. In order to reduce, minimize, or even eliminate, varying axial stresses (e.g.

compression stress or drag stress) experienced at the desired position, the force applied by the actuating system is thus controlled by axial monitoring of stresses by the first sensor at the desired position.

The dynamic seal allowing the first part and the second part to be axially displaced relative each other, the stress is compression or tension, the actuating system being arranged above a BOP in the riser and is configured to apply a force on the first or second part in the axial direction when the first and second parts are moved out of an axially neutral position. In this aspect, the actuating system may comprise a cylinder arrangement forming part of a relatively short telescopic section where a first part of the telescopic section is connected to the first riser part and a second part of the telescopic section is connected to the second riser part and the first and second parts of the telescopic section being axially movable relative each other. Alternatively, other suitable means able to be controlled by the control system to provide a push or pull force thereby compensating for relative axial movement/force between two riser parts, can be used. In order to minimize, or at least reduce, variations in axial forces, i.e. compression/tension at the desired position, the admission is preferably controlled by the real-time monitoring of experienced axial forces from at least the first sensor, and the actuating system is controlled to provide a force in an axial direction such that the stress experienced at the desired position is minimized or reduced.

The dynamic seal between the first and second riser parts serves to provide for a fluid-tight connection between an inside of the riser and the outside of the riser even in situations where the first riser part moves relative the second riser part. The first and second riser parts may thus not be directly connected to each other, but they are connected via the flexible connection comprising the dynamic seal.

In relation to the second embodiment, as an example of varying stresses experienced by the wellhead, a possible situation may be the following:

- weight of the BOP is 300 tons, which weight is working downwardly,
- the riser tensioning system pulls upwardly, by a force which results in 50 tons upward on the wellhead,
- the net force experienced by the wellhead, under ideal conditions (i.e. conditions where the riser tensioning system compensates for all heave movements, is thus 300 tons−50 tons=250 tons downwardly (i.e. neutral position),
- however, it has proven that the weight of the riser on the wellhead is not constant, i.e. the tension experienced by the riser tensioning system is not constant and is not able to compensate for all movements of the riser,
- in fact the weight of the riser on the wellhead can vary up to +/−30 tons, which again leads to a net varying load experienced by the wellhead which is 250 tons +/−30 tons, i.e. ranging from (250−30=)220 tons to (250+30=)280 tons,
- thus the wellhead may experience a net axial weight difference of 60 tons. This axial weight difference will also result in possible fatigue of the wellhead (in the long run). Thus, the axial weight differences should also be accounted for such as to reduce fatigue.

Third embodiment:

In a third embodiment, where the stress is torsion forces, it is provided a system wherein the actuation system comprises a plurality of inclined cylinders connected to the first part and the second part, which inclined cylinders are arranged such that, upon torsion in one direction of the first part relative the second part (or relative between a second part and third part etc.), the plurality of cylinders may reduce any torsional forces in the desired position by providing a force in an opposite direction of the torsional forces between the first and second part (or relative between a second part and third part etc.). If seen from the side, the inclined cylinders may be arranged outside the flexible connection, with a center axis of the cylinders angled relative a center axis of the first part extending through the second part via the flexible connection such that the cylinders are arranged tangentially around the flexible connection.

Summarized, in all embodiments, the system according to the present invention compensates for all friction that may occur, i.e. variable friction and or hysteresis effect(s) in different parts making up the system. The friction is e.g. dependent on the force from the hydraulic cylinders. Furthermore, the system also compensates for the hysteresis effects from the rubber in the flex joint connection as well as it will compensate for variations in the riser tension and friction in bearings (e.g. in bearings in the hydraulic cylinders). By using the system, the bending moment at the desired position, e.g. at the wellhead, is reduced by up to 99%. The system further compensates for pipe-in-pipe effect, and dependent on the hydraulic damping and the regulating speed it is also compensated for vortex-induced vibrations (VIV). In addition, the stresses resulting from axial movement of the riser and/or torsion, is reduced or eliminated. Typically, the neutral position, in the first, second and third embodiment, corresponds to the position where the riser is tensioned, e.g. by tensioning system, and the desired position experiences zero forces or stress or constant forces or constant stress. In theory, this should be enough, and under ideal conditions the desired position would not experience any forces or stress resulting in fatigue challenges over time. However, it has proven that the desired position experiences forces or stresses which are not constant, i.e. the forces or stresses will fluctuate or variate around the neutral position and result in fatigue over time. Thus, the invention minimizes and or reduces the forces or stresses experienced at the desired position, including at least one of the following: bending moments, tension, compression and torsion.

The actuating system may be arranged close to the desired position. The term 'close to the desired position' shall be understood as in a distance which is less than 25% of the total length of the riser, more preferably in a distance which is less than 20% of the total length of the riser, even more preferably in a distance which is less than 15% of the total length of the riser, even more preferably in a distance which is less than 10% of the total length of the riser, even more preferably in a distance which is less than 5% of the total length of the riser, and even more preferably in a distance which is less than 1% of the total length of the riser. Hence, the actuating system, at least when used in reduction of stress forces, provide for a better force reducing effect when arranged as close as possible to the desired position.

Throughout the description different wording have been used to describe where the desired position may be, e.g. 'along a riser', in a 'riser column' etc. It is clear that these positions can be anywhere extending from (and including) the wellhead and up to the floating installation, such as in an upper half of the riser, at a lower half of the riser including: at a wellhead, a connection between a wellhead and a X-mas tree, a lower marine riser package (LMRP), a blow out preventer (BOP), a riser joint, an intervention stack etc.

These and other embodiments of the present invention will be apparent from the attached drawings, where:

DETAILED DESCRIPTION OF A PREFERENTIAL FORM OF EMBODIMENT

Figure 1:
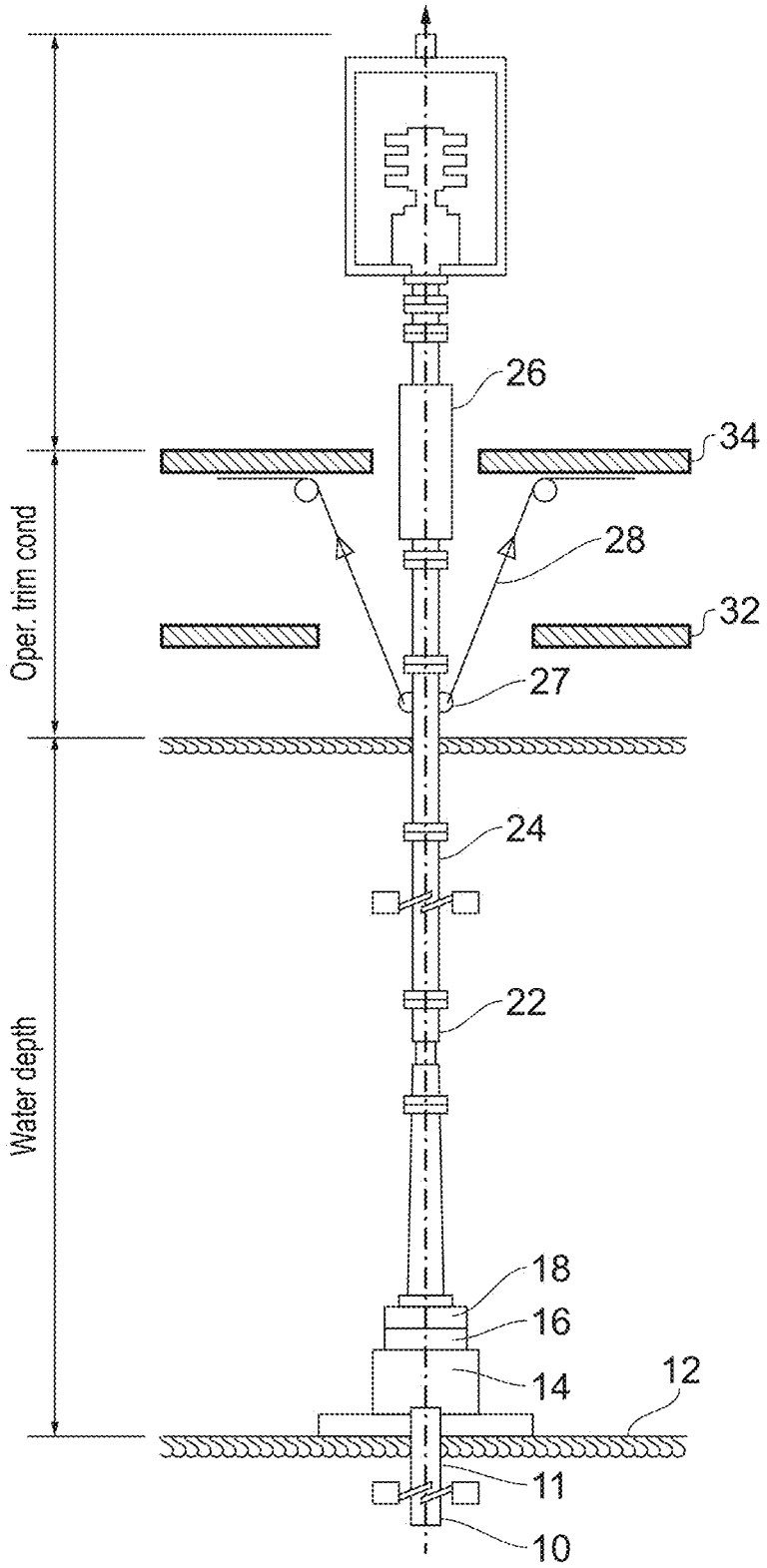
FIG. 1 (Prior Art)
FIG. 1 discloses a prior art riser system.

In FIG. 1 there is shown a prior art riser system for use in well completions and workover operations. A well 10 has been drilled from the seabed 12 into the earth and completed in the normal manner, capped with a wellhead and subsea Christmas tree 14. A BOP or lower riser package (LRP) 16 is locked onto the Christmas tree 14. An emergency disconnect package (EDP) 18 is locked to the LRP. Above the EDP there is normally arranged a stress joint that will handle bending moments in the riser. The stress joint may be in the form of a bending restrictor. At the lower end of the riser there is also a safety joint or weak link 22. The riser 24 itself consists of a number of pipes that are screwed or otherwise locked together to form a pipe string as is well known in the art. At the top of the riser there is a telescopic joint 26. In the drawing the telescopic joint is shown in its collapsed position. The riser 24 is held in tension using a tensioner system 28 in the normal manner. A surface flow tree is attached to the top of the riser and held in tension using the heave compensator (not shown). The vessel has a cellar deck 32 and a drill floor 34. All operations are conducted on the drill floor.

Figure 2:
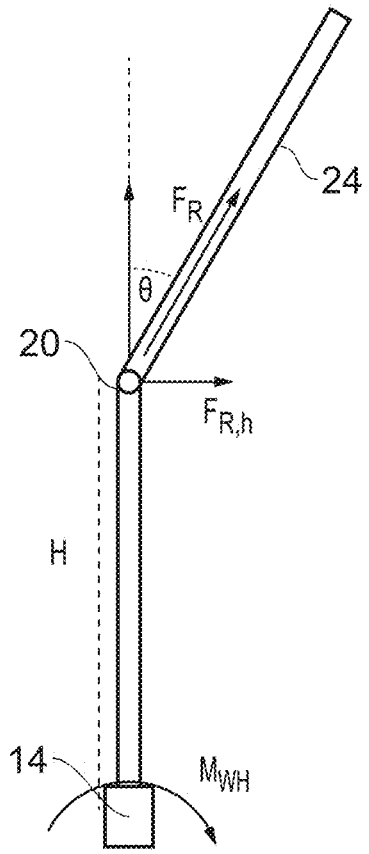
FIG. 2 is shown a simplified sketch of a part of the riser system as depicted in FIG. 1.

In FIG. 2 is shown a simplified sketch of a part of the riser system as depicted in FIG. 1 showing the bending moment at wellhead 14. A flex joint 20 is mounted between the riser 24 and wellhead 14. The flex joint is typically located at a height H from the wellhead 14 datum to the flex joint axis. The riser can also be said to comprise two parts (see FIG. 5, first riser part 45 and second riser part 46) joined at the flex joint 20. As can be seen from FIG. 2, when tension is applied to the riser, an upward force $F_R$ acts on the wellhead 14. When the riser 24 is at an angle θ this force will split into a vertical and a horizontal component. As will be understood, when the riser 24 is vertical, the horizontal component is zero but as the angle increases, the horizontal component will also increase. The horizontal component will result in a bending moment generated at the wellhead 14, as represented by the formula $$M_{WH}=F_{R,h}\times H+k_\theta\times\theta$$

where

Figure 3:
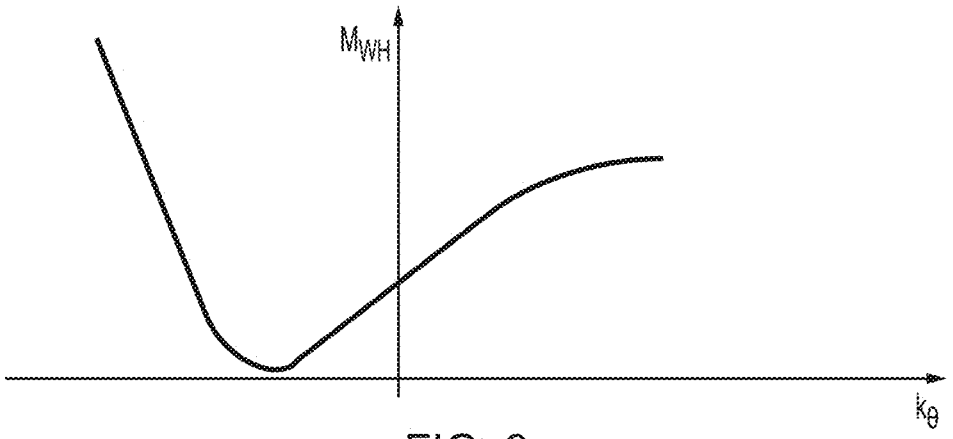
FIG. 3 is a diagram of an example of a specific equation, showing the curve of the bending moments $M_{wh}$ as a result of varying the flex joint stiffness $k_\theta$.

H: Height from wellhead datum to flex joint axis

θ: Global flex joint angle $F_R$: Riser tension at flex joint axis $F_{R,h}$: Horizontal component of $F_R$ $k_\theta$: Rotational flex joint stiffness FIG. 3 is a diagram of one solution to the above equation, showing the curve of the bending moments $M_{wh}$ as a result of varying the flex joint stiffness $k_\theta$. This shows that even when the flex joint stiffness $k_\theta$ is zero, which is an idealized joint with no friction or stiffness, there is still bending moment $M_{wh}$ acting on the wellhead 14, as can bee seen as the graph crosses the Y-axis in a distance from the X-axis. The bending moments on the wellhead 14 will as indicated with the graph also with an increasing flex joint stiffness have an increasing value. The diagram also shows that the least moment on the wellhead 14 is achieved if the stiffness in the flexible joint between two parts of the riser 24 is negative. This theoretical considerations show that if it could be possible to design a flex joint with a negative "stiffness", the result will be an arrangement giving the least moment forces acting on the wellhead. There is a range of negative stiffness values for the flex joint stiffness $k_\theta$ which gives this desired effect on the wellhead. One can see this in the Figure in that the graph has a dip close to a zero value for the bending moment at the wellhead, $M_{wh}$, for a negative value of the joint stiffness $k_\theta$. One should here also notice that with a negative flex joint stiffness $k_\theta$ which has a larger negative value, there will again be an increasing bending moment at the wellhead, as indicated in the graph. The challenge is to change the locking stiffness of a joint between two parts of a riser from positive to negative. This will reduce the overall dynamical/static bending moment on the wellhead during subsea operations.

Figure 4:
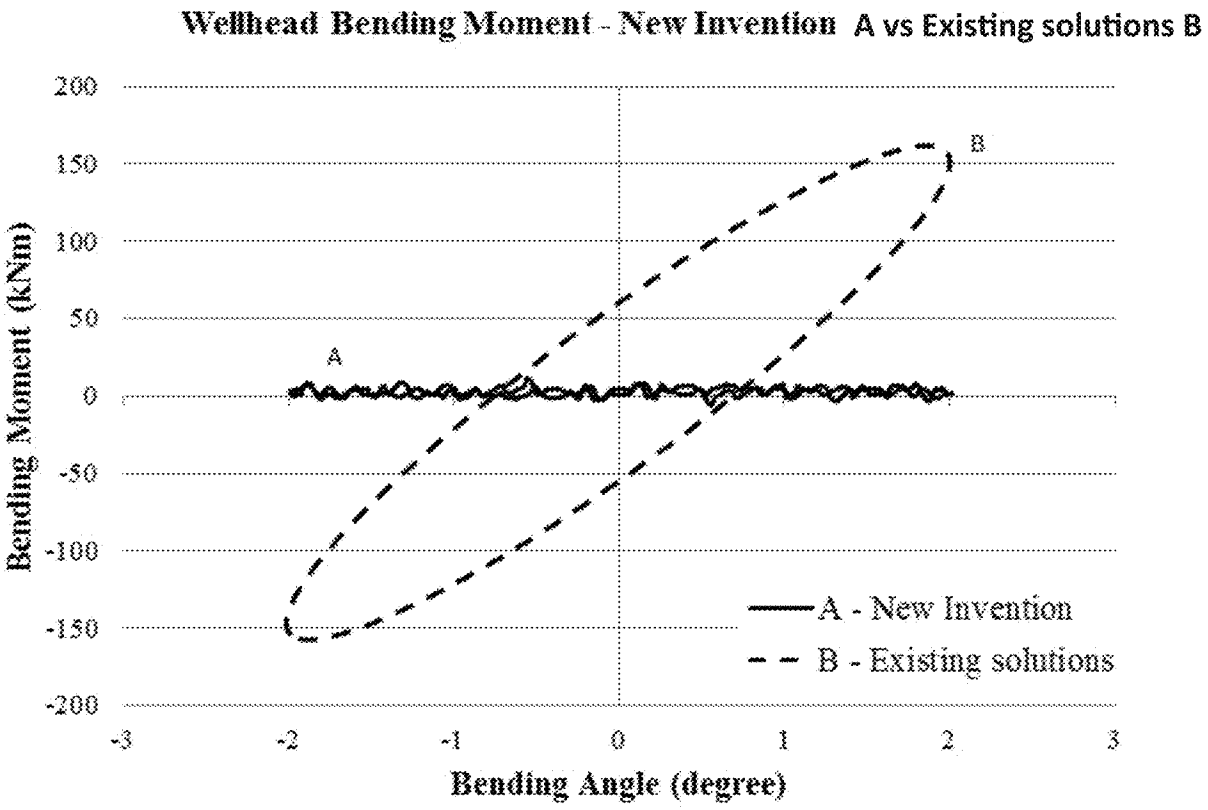
FIG. 4 shows a plot of bending moment (kNm) on the Y-axis vs. deviation angle (degree) on the X-axis for the invention (A—New invention) compared to prior art, i.e. existing solutions (B—Existing solutions).

FIG. 4 shows a plot of bending moment (kNm) on the Y-axis vs. deviation angle (degree) on the X-axis for the invention (A=New invention, hereinafter denoted 'A') compared to prior art solutions (B=Existing solutions, hereinafter denoted 'B'). Experiments using the prior art solutions, have proven that the influence of friction is significant and essential. If there had been no friction in the system and the tension in the riser had been constant, it would have been possible to reduce the bending moment at the wellhead by approximately 80%. The rest value (approximately 20%) is due to hysteresis effect in the flex joint rubber. However, due to friction in the bearings and other parts, the efficiency is significant reduced. The friction depends on the force from the hydraulic cylinders and real tests prove the calculated reductions. FIG. 4 shows the influence of the increased friction as function of increased force in the cylinders. The 45 degrees elliptical curve (B) has a width caused by the rubber hysteresis in the flex joint rubber. When the cylinder pressure in the hydraulic cylinders in the actuating system increases, the friction in bearings make an additional hysteresis effect and the width of the elliptical curve increases. This reduces the efficiency in the bending moment at the desired position dramatically. As can be seen from the plot of (B), the amplitude of the bending moment is in the magnitude of +/−130 kNm. However, by using the present invention (illustrated by curve A) it is clear that the amplitude of the bending moment is significantly reduced to about +/−10 kNm. Thus, the present invention is much closer to the ideal situation, i.e. a situation where the elliptical curve cycles on the X-axis with as small value as possible on the Y-axis, resulting in minimal bending moments in the desired position.

Thus, as is apparent from FIG. 4, the system according to the present invention compensates for all friction that may occur, i.e. variable friction and or hysteresis effect(s) in different parts making up the system. The friction is e.g. dependent on the force from the hydraulic cylinders. Furthermore, the system also compensates for the hysteresis effects from the rubber in the flex joint connection as well as it will compensate for variations in the riser tension and friction in bearings (e.g. in bearings in the hydraulic cylinders). By using the system, the bending moment at the desired position, e.g. at the wellhead, is reduced by up to 99%. The system further compensates for pipe-in-pipe effect, riser tensions variations and dependent on the hydraulic damping and the regulating speed it is also compensated for vortex-induced vibrations (VIV).

Figure 5:
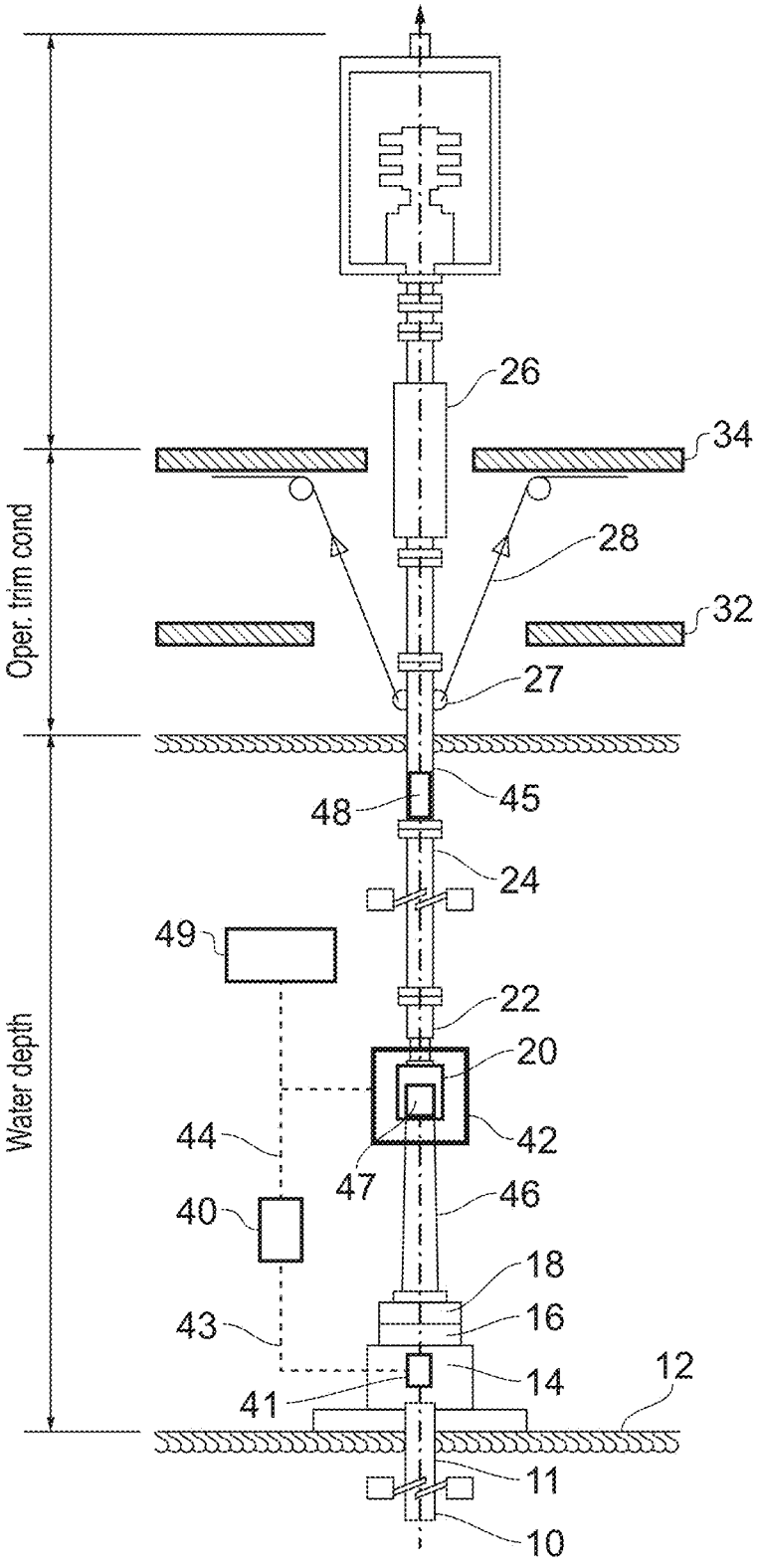
FIG. 5 shows a setup of an offshore system and an example of the positioning of the invention in such a system in a first embodiment of the invention.

FIG. 5 shows a setup of an offshore system and an example of the positioning of the invention in a riser system in a first embodiment of the invention. Many of the features are similar to the features discussed in relation to the prior art of FIG. 1. However, FIG. 5 further discloses a system of reducing bending moment in one or more desired positions along a riser according to the invention. The riser 24 is tensioned by the tensioner system 28 and is connected to a floating structure and a seabed structure 11, 14 and comprises a first riser part 45 and a second riser part 46, which first and second riser parts 45, 46 are connected by a flexible joint 20 allowing the first riser part and the second riser part 45, 46 to be angular displaced relative each other. The flexible joint 20 is any flexible joint or connection which allows two parts to be angularly displaced relative each other while still being connected. The system comprises a first sensor 41 for real-time monitoring of bending moments at the desired position, the first sensor 41 is positioned at or close to the desired position. In the disclosed embodiment, the desired position is at the wellhead 14 and the first sensor 41 is arranged at the wellhead 14. The system further comprises an actuating system 42 arranged at the flexible connection 20. The actuating system 42 being connected to said first and second parts 45, 46 and is configured to apply a force to the first or second riser parts 45, 46 when the first and second riser parts 45, 46 are moved out of a neutral position, which force is applied in the same direction as the movement out of neutral position. A control system 40 is adapted to receive monitoring data from the first sensor 41. Such monitoring data may be transferred through first connection line 43, or may also be transferred wirelessly. The control system 40 is connected to the actuating system 42 via a second connection line 44 and is able of providing instruction signals to the actuating system 42. Furthermore, the control system 40 is configured to, based on said monitoring data from the first sensor 41, calculate a real-time set of data for control of the applied force of the actuating system 42 by instructing the actuating system 42 to act accordingly, such as to provide a reduced bending moment at said desired position along the riser 24, i.e. the wellhead 14 in the disclosed embodiment. It shall thus be noted that the position of the first sensor 41 may be in a distance from the desired position (the wellhead 14 in the disclosed embodiment), e.g. the desired position is a position in a distance below or above the upper end of the wellhead and the first sensor 41 is positioned at a connection between the X-mas tree and an intervention stack. The system is further disclosed comprising a second sensor 47 for real-time monitoring of a bending angle θ at the flexible connection 20 and a third sensor 48 for real-time monitoring of tension in the riser 24. The control system 40 may then calculate the real-time set of data for control of the applied force of the actuating system 42 based on monitoring data from the first sensor 41, the second sensor 47 and the third sensor 48. The actuating system 42 may be connected to a hydraulic fluid reservoir, accumulator and pump (details of which is disclosed in FIG. 7), which may provide for supply of additional fluid under pressure to the hydraulic cylinders in the actuating system 42.

Figure 6A:
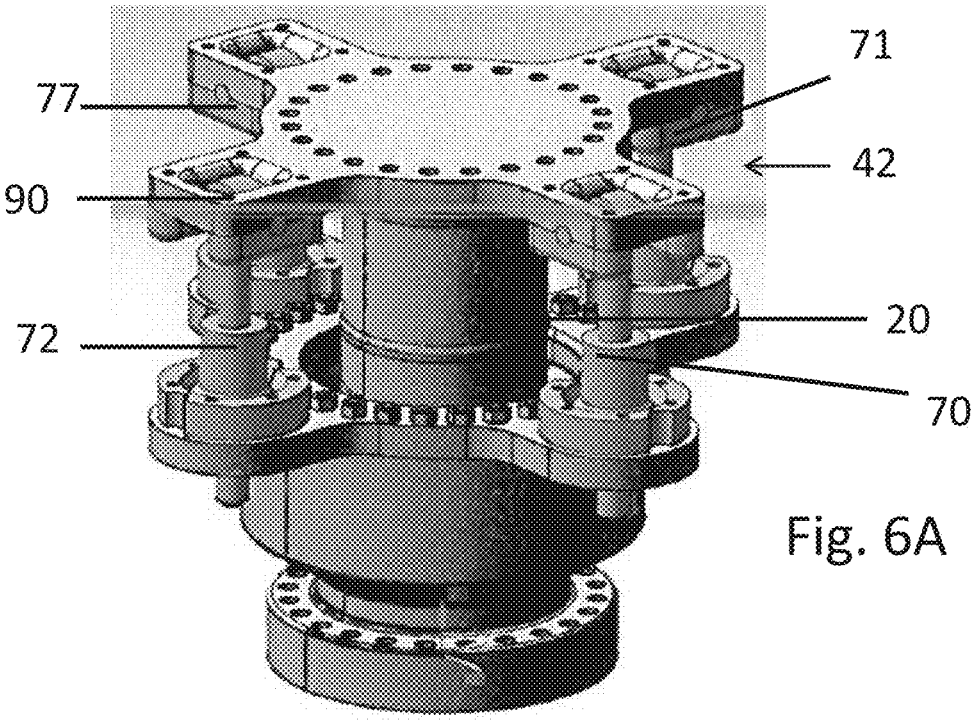
FIG. 6A-C shows an aspect of the invention in different views.
Figure 6B:
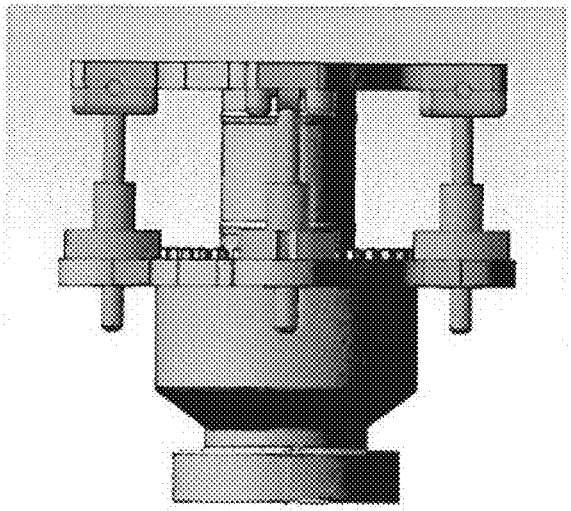
Figure 6C:
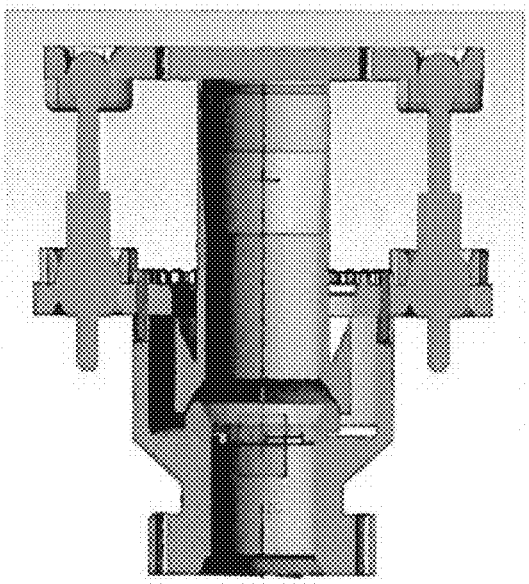

FIG. 6A-C shows an aspect of the invention in different views, wherein FIG. 6A shows an overview of the hydraulic cylinders in the actuating system 42 around a flexible joint 20, FIG. 6B shows a side view of FIG. 6A, and FIG. 6C shows a plan view from the side where the flexible joint and actuating system has been cut in the axial direction showing some details of the hydraulic cylinders and the flexible joint. The cylinders are double-acting hydraulically cylinders with same pressure area at both sides. Furthermore, in the disclosed embodiment, it is disclosed 8 spherical bearings 90 with fixing brackets for bolting to the flexible joint 20. The joint 20 is connected to a first riser part and a second riser part 45, 46 (the riser parts are not disclosed in this Figure).

Figure 7:
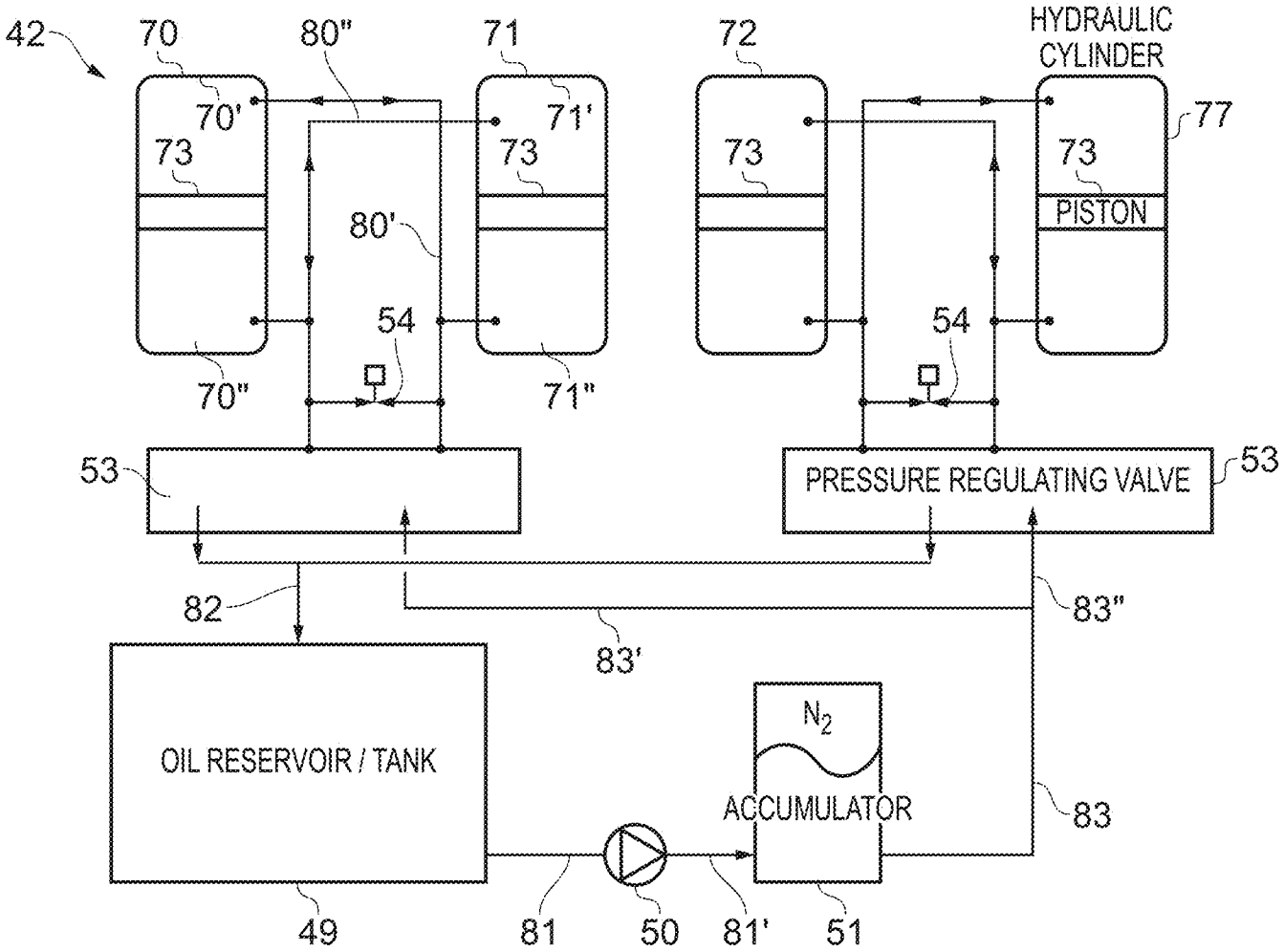
FIG. 7 shows a hydraulic flow diagram for the actuating system according to the present invention.

FIG. 7 shows a hydraulic flow diagram for the actuating system 42 according to the present invention. The flow diagram discloses a closed circuit. The directions of the flow in each of the lines are shown by the arrows in each line. In the Figure, four hydraulic cylinders 70, 71, 72, 77 are disclosed, each having a piston 73 inside, the piston 73 separating the chamber in the hydraulic cylinder 70, 71, 72, 77 in a first volume (above the piston 73) and a second volume (below the piston 73). The hydraulic system comprises a hydraulic fluid reservoir 49 comprising hydraulic oil, the hydraulic fluid reservoir 49 is connected to a hydraulic pump 50 via line 81. The hydraulic pump 50 is connected to an accumulator 51 via line 81' and is configured to pressurize fluid from the hydraulic fluid reservoir 49 into the accumulator 51.

The accumulator 51 comprises pressurized hydraulic fluid and a gas, such as nitrogen (N2). The accumulator 51 is connected to two pressure regulating valves 53 via line 83 which line branches off in lines 83' and 83", where each of the pressure regulating valves 53 are connected to a first volume (i.e. an upper chamber) 70', 71' in one hydraulic cylinder 70, 71 and a second volume 70", 71" in another hydraulic cylinder 70, 71. The first volume 70', 71' is separated from the second volume 70", 71" within each hydraulic cylinder by a piston 73.

The hydraulics functions such that if the control system 40 (not shown in FIG. 7) calculates that the flexible joint is moving out of neutral position, an additional force is added by supplying pressure from the hydraulic fluid reservoir 49 to dedicated first and second volumes of the hydraulic cylinders dependent on the direction of the force. The amount of pressurized fluid may be adjusted by opening, closing or choking the pressure regulating valves 53 based on instructions from the control system. For example, if hydraulic cylinder 70 and hydraulic cylinder 71 is arranged on opposite sides of the flexible joint 20, then pressurized fluid may be added to the first volume 70' of hydraulic cylinder 70 and to the second volume 71" of the hydraulic cylinder 71 via line 80'. The remaining hydraulic cylinders are configured in a similar manner in relation to the other hydraulic cylinders 72, 77. However, when the control system 40 calculates that no additional force is required, fluids may flow back from the respective pressurized first 70', 71' and/or second volumes 70", 71" to the pressure regulating valves 53 and further via line 82 back into the hydraulic fluid reservoir 49. The process is then continuously repeated based on the forces acting on the flexible joint 20.

If desired, it is obvious that line 80 may further be connected to any of the remaining first or second volumes of the hydraulic cylinders 72 and/or 77.

However, it is preferable that if two hydraulic cylinders 70, 71 72, 77 are arranged on opposite sides of a flexible joint, the two first and second volumes are connected as described above such as to achieve an increased force.

There may be arranged a fail safe open on/off valves 54 between opposite hydraulic cylinders 70, 71 and 72, 77, respectively.

Although it has been described and disclosed that a first volume of one hydraulic cylinder is connected to a second volume in another cylinder, it is clear that the first volume of one cylinder may be connected to a first volume of a second cylinder. Furthermore, a second volume in one cylinder may be connected to a first volume or a second volume in another cylinder.

Figure 8:
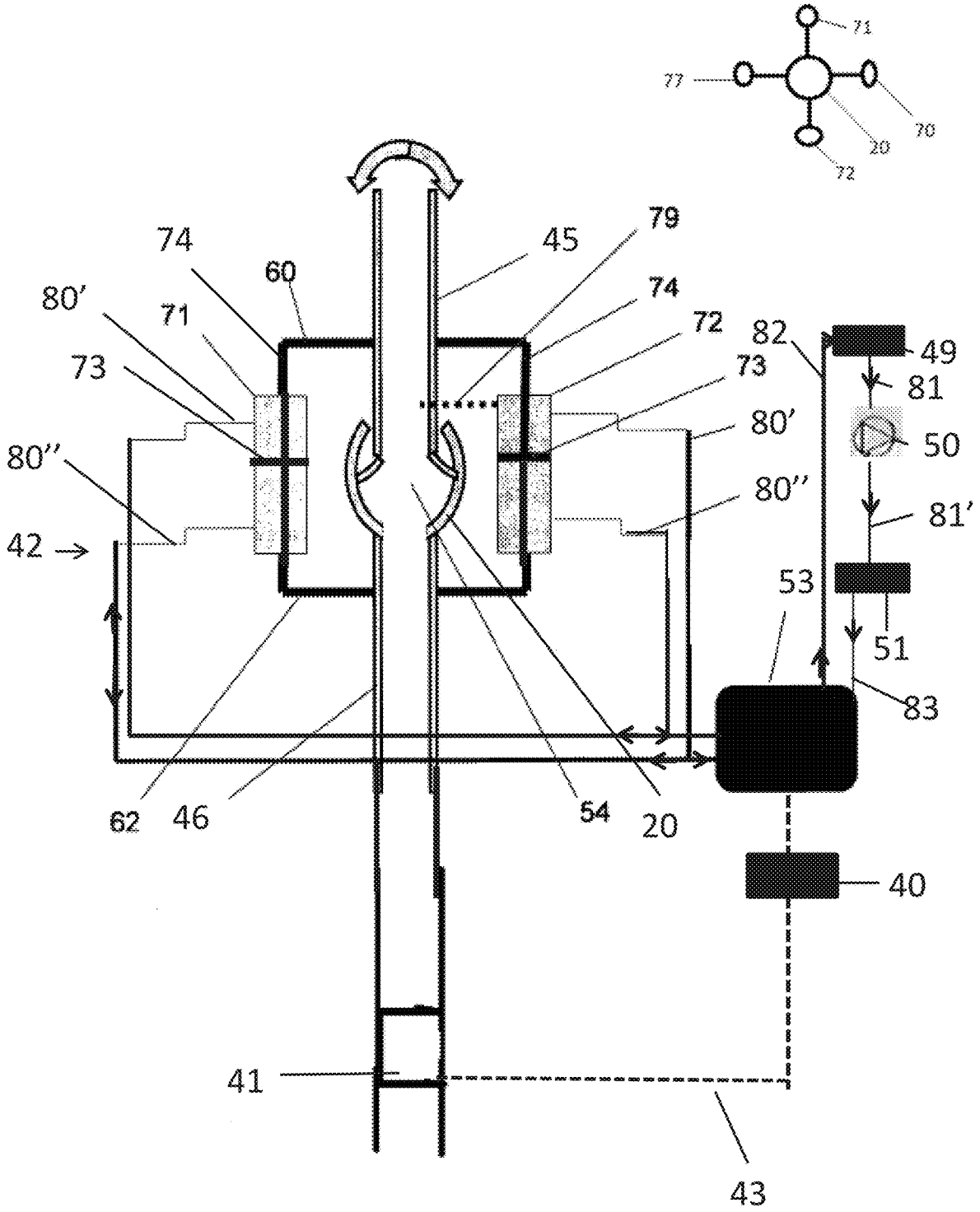
FIG. 8 shows a setup having four cylinders (only two is shown)

FIG. 8 shows a setup having four cylinders (only two is shown in the large drawing) providing forces to the joint 20. Between two shoulders 60, 62, which shoulders 60, 62 are connected to the first and second riser parts 45, 46 respectively, there are arranged a number of hydraulic cylinders 70, 71, 72, 77 having pistons 73. The connection between the shoulders 60, 62 can be via spherical bearings 90 with fixing brackets for bolting to the flexible joint 20. The piston 73 is connected to a through-going piston rod 74 which through-going piston rod 74 in its two ends is attached to the respective shoulders 60, 62. The piston 73 is fixed relative the through-going piston rod 74. The piston 73 is reciprocally movable in the cylinder 72 thus limiting the cylinder into a first and second chamber. Each chamber is connected to a fluid line 80' and 80" for supplying fluid under pressure to one or the other chamber, for thereby regulating the force from the actuating system 42, i.e. the hydraulic cylinders 70, 71, 72, 77 on the flexible joint 20. The fluid lines are connected to an accumulator (see details in FIG. 6) and the flow to the different chambers of the different cylinders in the cylinder arrangement is controlled by a control system 40. The control system 40 receives monitoring data from the first sensor 41 through first connection line 43 and provides instruction signals to the hydraulic cylinders 70, 71, 72, 77 dependent on a calculated real-time set of data. The system also includes sensors for measuring the global riser angle θ as well as pressure and temperature transmitters as is common in control systems. The arrangement function such that the angle size and direction is measured, as well as the bending moment in the desired position measured by the first sensor 41, and when the riser starts bending the control system 40 will direct pressurized fluid into the chamber above the pistons in the different hydraulic cylinders 70, 71, 72, 77 to force an increase of the bending angle in the flexible joint 20.

The piston and cylinders are preferably attached to the shoulders with flexible joints to avoid excessive bending.

The system is shown having four cylinders equally disposed with 90 degree intervals around the flexible joint 20 but the number may be any that will achieve the desired result. In the actuating system 42, the first volume in one hydraulic cylinder 70, 71, 72, 77 may be connected to a first volume or a second volume in another hydraulic cylinder 70, 71, 72, 77 and/or a second volume in one cylinder is connected to a first volume or a second volume in another cylinder. This provides for a potential additional force to the joint 20.

As indicated in the figure there may be connection line 79 between the hydraulic cylinders 72 and the internal bore 54 of the riser through the joint. By this one may pressure compensate the system for the pressure within the riser and thereby have the possibility of regulating the systems and the forces from this arrangement on the riser parts, independent of the pressure within the internal bore 54.

Figures 9A, 9B, 9C:
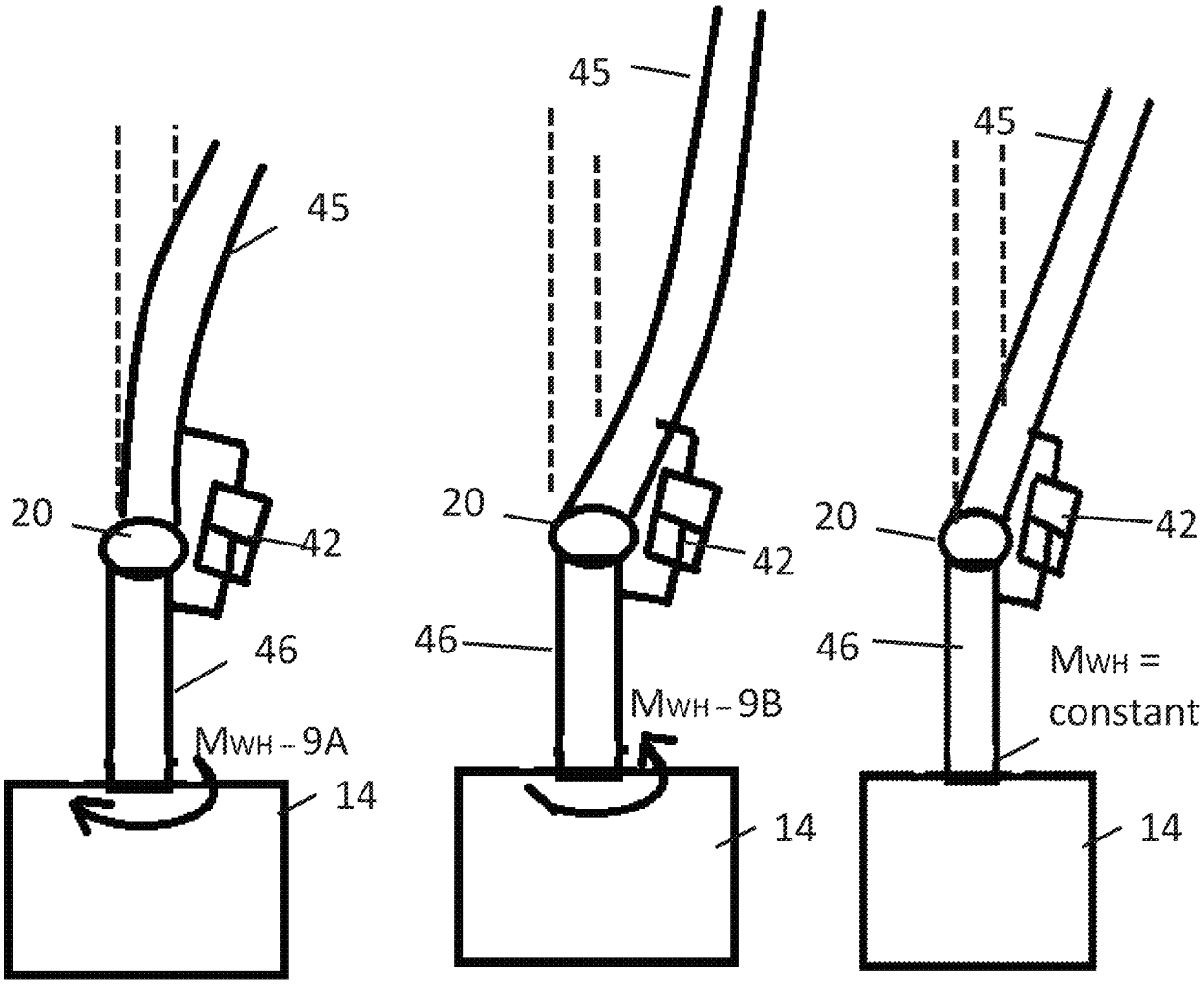
FIG. 9A shows example of experienced bending moments at the subsea wellhead when the actuating system is applying too little force when the floating structure is drifting in the right hand direction on the drawing.
FIG. 9B shows example of experienced bending moments at the subsea wellhead when the actuating system is applying too much force when the floating structure is drifting in the right hand direction on the drawing.
FIG. 9C shows example of experienced bending moments at the subsea wellhead when the actuating system is applying ideal force when the floating structure is drifting in the right hand direction on the drawing.

FIG. 9A shows example of experienced bending moments at the subsea wellhead when the actuating system is applying too little force when the floating structure is drifting in the right hand direction on the drawing. In the illustrations in FIGS. 9A-C, the desired position is at the wellhead 14. The situation in FIG. 9A is as follows: the actuating system 42 is not providing sufficient force acting in the same direction as the movement out of neutral position of the joint 20, thus both the first part 45 and the second part 46 will try to compensate for the movement out of the neutral position resulting in a bending moment which will propagate downwardly towards the wellhead 14. The direction of the bending moment experienced by the wellhead 14 is indicated by the arrow $M_{WH}$—9A.

FIG. 9B shows example of experienced bending moments at the subsea wellhead when the actuating system is applying too much force when the floating structure is drifting in the right hand direction on the drawing. The situation in FIG. 9B is as follows: the actuating system 42 is providing too much force acting in the same direction as the movement out of neutral position of the joint 20, thus both the first part 45 and the second part 46 will overcompensate for the movement out of the neutral position resulting in a bending moment which will propagate downwardly towards the wellhead 14. The direction of the bending moment experienced by the wellhead 14 is indicated by the arrow $M_{WH}$—9B, which bending moment will act in the opposite direction than in FIG. 9A.

FIG. 9C shows example of experienced bending moments at the subsea wellhead when the actuating system is applying ideal force when the floating structure is drifting in the right hand direction on the drawing. In this Figure the bending moment $M_{WH}$ is constant. A constant bending moment will normally not result in fatigue, thus the aim of the first embodiment of the invention is to provide a system which operates as indicated in FIG. 9C where $M_{WH}$ is constant and any bending moments resulting from movement in the floating structure, is compensated for .In such ideal conditions, the moment transferred from the flexible connection 20

Figure 10:
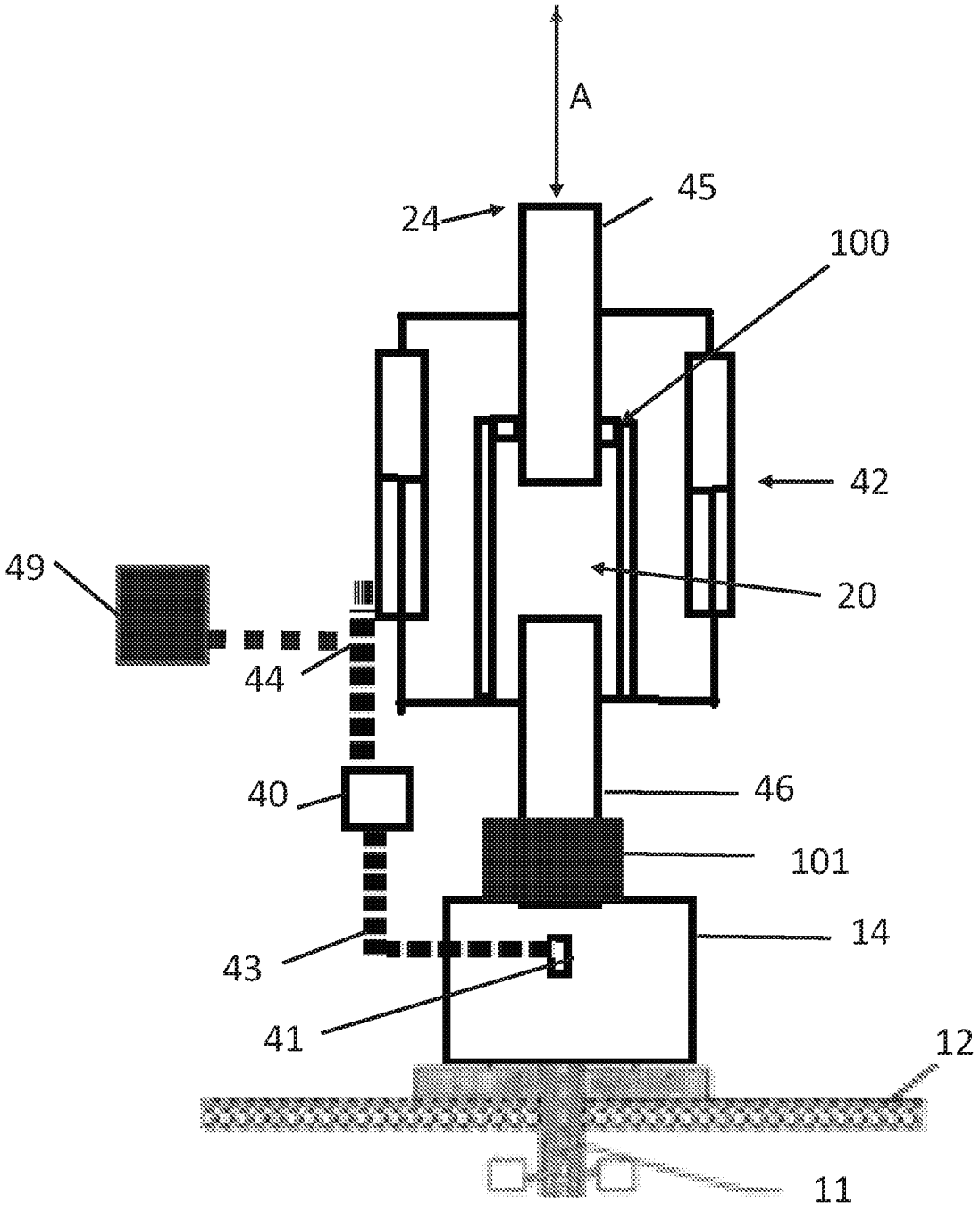
FIG. 10 shows a second embodiment of the invention for reducing axial or compression stresses in a desired position.

FIG. 10 shows a second embodiment of the invention for reducing stresses in a desired position. In the second embodiment, where the stress is compression or torsion, it is provided a system wherein the flexible connection 20 comprises a dynamic seal 100 allowing the first part 45 and the second part 46 axial movement relative each other. The actuating system 42 being arranged above a BOP 101 in the riser 24 and is configured to apply a force on the first or second part in the axial direction (direction indicated by arrow A) when the first and second parts 45, 46 are moved out of an axially neutral position. The actuating system 42 is disclosed as a cylinder arrangement similar to the actuating system described in relation to FIGS. 5, 6A-C and 7 above describing the first embodiment, may be used in this second embodiment as well and is incorporated in the second embodiment.

Typically, the neutral position in all aspects corresponds to the position where the riser is tensioned, e.g. by tensioning system, and the desired position experiences zero forces or stress or constant forces or constant stress. In theory, this should be enough, and under ideal conditions the desired position would not experience any forces or stress resulting in fatigue challenges over time. However, it has proven that the desired position experiences forces or stresses which are not constant, i.e. the forces or stresses will fluctuate or variate around the neutral position and result in fatigue over time. Thus, the invention minimizes and or reduces the forces or stresses experienced at the desired position. This is achieved by for example a short section of flexible connection 20, i.e. axially flexible connection 20 such as a telescopically controlled pipe 20, above the BOP 101 in the riser 24. The telescopically controlled pipe 20 comprising the actuating system 42. In order to reduce or eliminate the stress forces in the desired position on a seabed structure 11, 14, e.g. wellhead 14 on top a well 11. In FIG. 10, a first sensor 41 is provided, which first sensor 41 is configured to monitor stresses at the desired position and provide real-time monitoring of stresses at the desired position. The actuating system 42 is arranged at the flexible connection 20, and is configured to apply a force to the first or second part when the first and second parts 45, 46 are moved out of a neutral position. The control system 40 is adapted to receive monitoring data from the first sensor 41 wirelessly or via a first connection line 43. The control system 40 is connected to the actuating system 42 and is able of providing instruction signals to the actuating system 42 wirelessly or via a second connection line 44 and is able of providing instruction signals to the actuating system 42. The control system 40 is able to, based on said monitoring data from the first sensor 41, calculate a real-time set of data for control of the applied force of the actuating system 42 and instructing the actuating system 42 to act accordingly, such as to reduce the stress at said desired position either by compensating for tension or compression relative the neutral position by operating the actuating system 42. In order to reduce, minimize, or even eliminate, varying axial stresses (e.g. compression stress or drag stress) experienced at the desired position, the force applied by the actuating system 42 is thus controlled by axial monitoring of stresses by the first sensor 41 at the desired position. The hydraulics functions such that if the control system 40 calculates that the flexible connection 20 is moving out of neutral position, an additional force is added by supplying pressure from the hydraulic fluid reservoir 49 to dedicated first and second volumes of the hydraulic cylinders in the actuating system 42 dependent on the direction of the force or stress (as described in relation to the first embodiment in FIGS. 5, 6A-C and 7).

Figure 11:
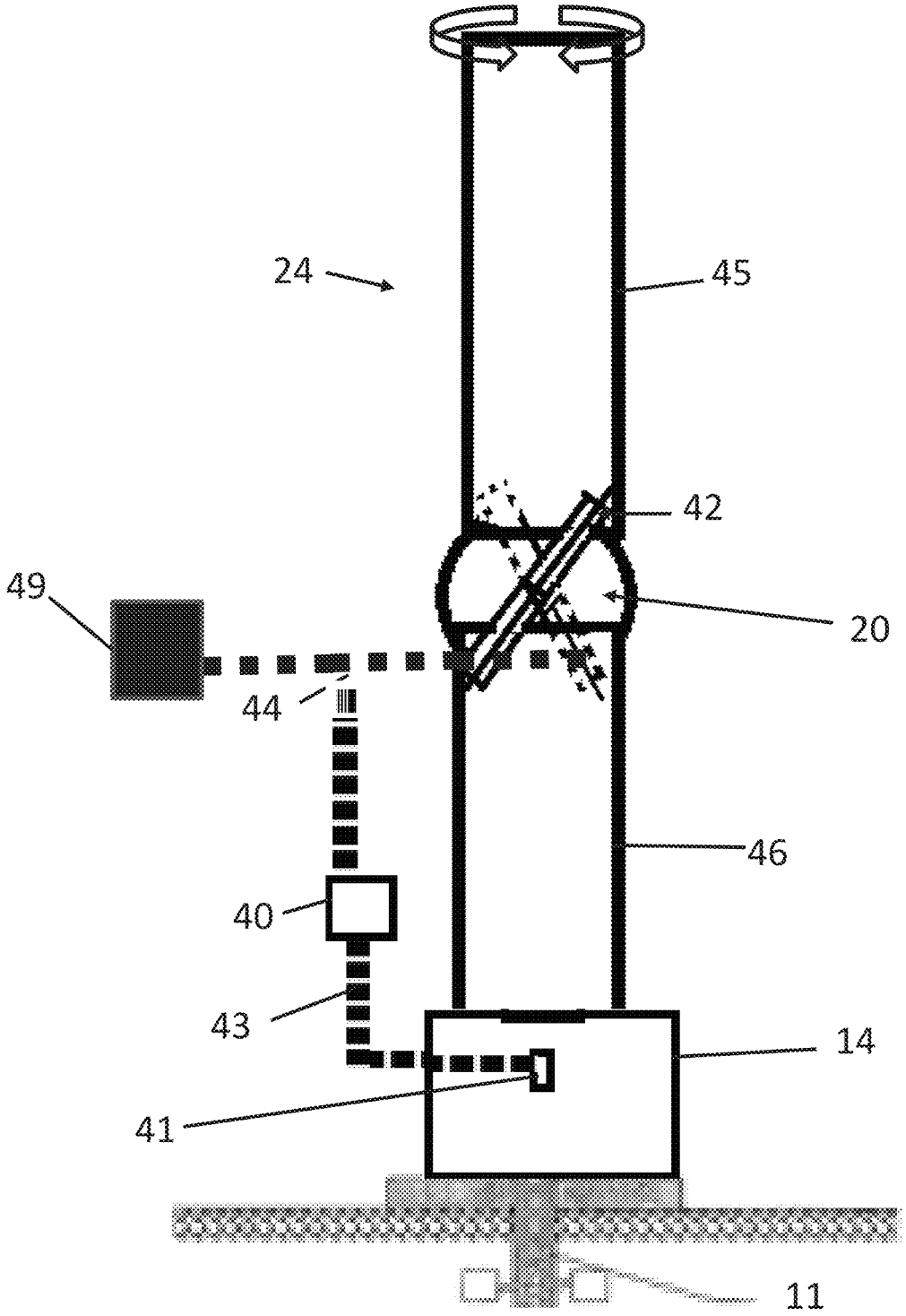
FIG. 11 shows a third embodiment of the invention for reducing torsion in a desired position.

FIG. 11 shows a third embodiment of the invention for reducing torsion in a desired position. In this embodiment, it is provided a system wherein the actuation system 42 comprises a plurality of inclined cylinders 42 connected to the first part 45 and the second part 46 of the riser 24. The inclined cylinders 42 are arranged such that, upon torsion in one direction of the first part 45 relative the second part 46 (or relative between a second part and third part etc.), the plurality of cylinders 42 may reduce any torsional forces in the desired position, in FIG. 11 exemplified as the wellhead 14 by providing a force in an opposite direction of the torsional forces between the first and second part 45, 46 (or relative between a second part and third part etc.). If seen from the side, the inclined cylinders 42 may be arranged outside the flexible connection 20, with a center axis of the cylinders angled relative a center axis of the first part 45 extending through the second part 46 via the flexible connection such that the cylinders 42 are arranged tangentially around the flexible connection 20. Thus, the arrangement of the cylinders 42 are very similar to the setup of cylinders as in the first embodiment in FIGS. 7 and 8, and the actuating system 42 is disclosed as a cylinder arrangement similar to the actuating system described in relation to FIGS. 5, 6A-C and 7 above describing the first embodiment, may be used in this third embodiment as well and is incorporated in the third embodiment.

Typically, the neutral position in all aspects corresponds to the position where the riser is tensioned, e.g. by tensioning system, and the desired position experiences zero torsional forces or constant torsional forces. In theory, this should be enough, and under ideal conditions the desired position would not experience any torsional forces resulting in fatigue challenges over time. However, it has proven that the desired position experiences torsional forces which are not constant, i.e. the torsional forces fluctuates or variate around the neutral position and result in fatigue over time. Thus, the invention minimizes and or reduces the torsional forces or stresses experienced at the desired position. In order to reduce or eliminate the torsional forces in the desired position on a seabed structure 11, 14, e.g. wellhead 14 on top a well 11, the actuating system comprises a set of inclined cylinders 42, where each of the cylinders are connected both to the first part 45 and the second part 46. In FIG. 11, a first sensor 41 is provided, which first sensor 41 is configured to monitor torsional forces at the desired position and provide real-time monitoring of torsional forces at the desired position. The actuating system 42 is arranged at the flexible connection 20, and is configured to apply a force to the first or second part when the first and second parts 45, 46 are moved out of a neutral position. The control system 40 is adapted to receive monitoring data from the first sensor 41 wirelessly or via a first connection line 43. The control system 40 is connected to the actuating system 42 and is able of providing instruction signals to the actuating system 42 wirelessly or via a second connection line 44 and is able of providing instruction signals to the actuating system 42. The control system 40 is able to, based on said monitoring data from the first sensor 41, calculate a real-time set of data for control of the applied force of the actuating system 42 and instructing the actuating system 42 to act accordingly, such as to reduce the torsional force at said desired position either by compensating experienced torsional forces relative the neutral position by operating the actuating system 42. In order to reduce, minimize, or even eliminate, varying torsional forces experienced at the desired position, the force applied by the actuating system 42 is thus controlled by torsional monitoring of forces by the first sensor 41 at the desired position. The hydraulics functions such that if the control system 40 calculates that the flexible connection 20 is moving out of neutral position, an additional force is added by supplying pressure from the hydraulic fluid reservoir 49 to dedicated first and second volumes of the hydraulic cylinders in the actuating system 42 dependent on the direction of the force or stress (as described in relation to the first embodiment in FIGS. 5, 6A-C and 7). For example, if the first part 45 is twisted or wrenched in one direction, the hydraulics functions such that when the control system 40 calculates this, i.e. the flexible connection 20 is moving out of neutral position, a compensating force is added in an opposite direction of the wrench- or twist movement, by supplying pressure from the hydraulic fluid reservoir 49 to dedicated first and second volumes of the hydraulic cylinders in the actuating system 42, thereby reducing the torsional forces experienced at the desired position. The invention is now explained with reference to a non-limiting embodiment. However, a skilled person will understand that there may be made alternations and modifications to the embodiments that are within the scope of the invention as defined in the attached claims. It is clear that other types of actuating systems may also be used, such as Electrical, Hydraulic, Electro-Hydraulic, Magnetic or a combination of these.

The invention claimed is:

1. A stress reducing system for reducing stresses at a desired position in an offshore production or drilling system, the offshore production or drilling system comprising a seabed structure, a floating structure and a riser extending between the seabed structure and the floating structure, the riser being tensioned and comprising at least a first part and a second part which is connected to the first part via a first flexible connection which is configured to allow axial, angular and/or rotational movement between the first and second parts, said stress reducing system comprising:

a first sensor which is configured to provide real-time monitoring of stresses at the desired position, the first sensor being positioned at or close to the desired position;

an actuating system which is arranged at the flexible connection, the actuating system being connected to said first and second parts and being configured to apply a force to at least one of the first and second parts when the first and second parts are moved out of a neutral position relative to each other;

a control system which is adapted to receive monitoring data from the first sensor, the control system being connected to the actuating system and being configured to apply instruction signals to the actuating system;

wherein the control system is configured to calculate, based on said monitoring data from the first sensor, a real-time set of data for control of the applied force of the actuating system and instruct the actuating system to act accordingly so as to reduce stress at said desired position.

2. The system according to claim 1, wherein the stress results in bending moments at said desired position, wherein the flexible connection is a flexible joint allowing angular displacement of the first part relative to the second part, wherein the first sensor is configured to provide real-time monitoring of bending moments at the desired position, wherein the actuating system is configured to apply the force in the same direction as the movement of the first part relative to the second part out of neutral position, and wherein the control system is configured to calculate the real-time set of data for control of the applied force of the actuating system in order to provide a reduced bending moment at said desired position.

3. The system according to claim 2, further comprising:

a second sensor which is configured to provide real-time monitoring of a bending angle θ at the flexible joint; and a third sensor which is configured to provide real-time monitoring of tension in the riser;

wherein the control system is configured to calculate the real-time set of data for control of the applied force of the actuating system based on monitoring data from the first sensor, the second sensor and the third sensor.

4. The system according to claim 2, wherein the first sensor comprises a sensor system which is configured to provide input in relation to at least one of the magnitude, direction and orientation of the bending moment.

5. The system according to claim 2, wherein the actuating system is arranged around a circumference of the flexible joint.

6. The system according to claim 5, wherein the actuating system comprises a set of hydraulic actuators, each hydraulic actuator comprising a cylinder which includes a cylinder barrel and a through-going piston rod, the through-going piston rod having a fixed piston separating an inner volume of the cylinder barrel into a first volume and a second volume.

7. The system according to claim 6, wherein the piston rods of the hydraulic cylinders extend substantially in the same direction as a longitudinal axis of the riser.

8. The system according to claim 6, wherein the first volume in one cylinder is connected to one of the first volume or the second volume in another cylinder and/or the second volume in one cylinder is connected to one of the first volume or the second volume in another cylinder.

9. The system according to claim 2, wherein the system is adapted to reduce bending moments at a second desired position along the riser.

10. The system according to claim 1, wherein the desired position is located at a wellhead, at a distance below an upper end of the wellhead, at a connection between the wellhead and a X-mas tree which is mounted to the wellhead, at a lower marine riser package (LMRP), at a blow out preventer, or at a riser joint in a lower half of the riser.

11. The system according to claim 10, wherein the first sensor is positioned at a distance from the desired position.

12. The system according to claim 1, wherein the desired position is located in an upper half of the riser.

13. The system according to claim 1, further comprising means for monitoring readings of one or more of the following additional parameters:

an angle of different riser components, a temperature of different riser components, a tension of different riser components versus an inner pressure of a fluid in the riser, a torsion of different riser components versus an inner pressure of a fluid in the riser, a pressure experienced at different riser components, a tension in the riser versus effects of waves and/or currents on the riser, a tension in the riser versus a tension applied from a tension system holding the riser;

wherein the control system calculates the real-time data set taking into account the monitoring readings from said one or more additional parameters.

14. The system according to claim 1, further comprising:

a second flexible connection which is either (a) positioned between the first part and the second part and is configured t allow the first and second parts to be angularly displaced relative to each other, or (b) positioned between the second part and a third part of the riser and is configured to allow the second and third parts to be angularly displaced relative to each other;

wherein the first sensor is configured to provide real-time monitoring of bending moments at the desired position;

a second actuating system which is arranged at the second flexible connection, the second actuating system being connected to said second and third parts and being configured to apply a force to at least one of the second and third parts when the second and third parts are moved out of a neutral position relative to each other;

wherein the second actuating system is configured to apply the force in the same direction as the movement of the second part relative to the third part out of neutral position;

wherein the control system is adapted to receive monitoring data from the first sensor, the control system being connected to the second actuating system and being configured to provide instruction signals to the second actuating system;

wherein the control system is configured to calculate, based on said monitoring data from the first sensor, a real-time set of data for control of the applied force of the second actuating system to provide a reduced bending moment at said desired position and instruct the second actuating system to act accordingly.

15. The system according to claim 14, wherein the first flexible connection allows an axial and/or rotational movement between the first and second parts.

16. The system according to claim 14, further comprising:

a third flexible connection which is configured to allow axial, angular and/or rotational movement between the first and second parts;

a second sensor which is configured to provide real-time monitoring of stresses at the desired position, the second sensor being positioned at or close to the desired position;

a third actuating system which is arranged at the third flexible connection, the third actuating system being connected to said first and second parts and being configured to apply a force to at least one of the first and second part when the first and second parts are moved out of a neutral position relative to each other;

wherein the control system is adapted to receive monitoring data from at least one of the first sensor, the second sensor, and a third sensor, the control system is being connected to the actuating system and being configured to provide instruction signals to the third actuating system;

wherein the control system is configured to calculate, based on said monitoring data from the first, second and/or third sensors, a real-time set of data for control of the applied force of the third actuating system and instruct the third actuating system to act accordingly so as to reduce the stress at said desired position.

17. The system according to claim 1, wherein the first flexible connection comprises a dynamic seal which allows the first part and the second part to move axially relative to each other, and wherein the actuating system is arranged above a BOP in the riser and is configured to apply a force in an axial direction on at least one of the first and second parts when the first and second parts are moved out of an axially neutral position relative to each other.

18. A method of reducing stress at a desired position in an offshore production or drilling system, the offshore production or drilling system comprising a seabed structure, a floating structure, and a riser extending between the seabed structure and the floating structure, the riser being tensioned and comprising at least a first part and a second part which is connected to the first part via a flexible connection which is configured to allow axial, angular and/or rotational movement between the first and second parts, the method comprising:

providing a stress reducing system comprising an actuating system arranged at the flexible connection, the actuating system being connected to said first and second parts and being configured to apply a force to at least one of the first and second parts when the first and second parts are moved out of a neutral position relative to each other;

monitoring in real time stresses at or close to the desired position using a first sensor;

operating a control system to calculate a real-time set of data based on monitoring data from the first sensor and controlling the actuating system accordingly; and regulating the applied force of the actuating system to provide a force which reduces the stress at said desired position.

19. The method according to claim 18, wherein the stress results in bending moments, wherein the flexible connection is a flexible joint which is configured to allow angular displacement of the first part relative the second part wherein the first sensor provides real-time monitoring of bending moments at the desired position, wherein the force is applied in the same direction as the movement of the first part relative to the second part out of neutral position, and wherein the control system calculates the real-time set of data for control of the applied force of the actuating system to provide a reduced bending moment at said desired position.

20. The method according to claim 18, further comprising reducing stress at a second desired position by using a second actuating system and the same or an additional control system.

* * * * *